US010685621B1

(12) United States Patent
Kline et al.

(10) Patent No.: US 10,685,621 B1
(45) Date of Patent: Jun. 16, 2020

(54) CONTEXTUAL DISPLAY DIMENSION CONTROL IN ROLLABLE DISPLAY DEVICE TO REDUCE THE ADDICTION OF MOBILE DEVICE

(71) Applicant: International Business Machines Corporation, Armonk, NY (US)

(72) Inventors: Eric V. Kline, Rochester, MN (US); Sarbajit K. Rakshit, Kolkata (IN)

(73) Assignee: INTERNATIONAL BUSINESS MACHINES CORPORATION, Armonk, NY (US)

( * ) Notice: Subject to any disclaimer, the term of this patent is extended or adjusted under 35 U.S.C. 154(b) by 0 days.

(21) Appl. No.: 16/217,597

(22) Filed: Dec. 12, 2018

(51) Int. Cl.
*G09G 5/00* (2006.01)

(52) U.S. Cl.
CPC ..... *G09G 5/003* (2013.01); *G09G 2320/0666* (2013.01); *G09G 2340/045* (2013.01); *G09G 2340/0407* (2013.01); *G09G 2354/00* (2013.01); *G09G 2380/02* (2013.01)

(58) Field of Classification Search
None
See application file for complete search history.

(56) References Cited

U.S. PATENT DOCUMENTS

| | | | |
|---|---|---|---|
| 2009/0296249 | A1 | 12/2009 | Van Lieshout et al. |
| 2014/0333545 | A1 | 11/2014 | Lee et al. |
| 2016/0307545 | A1 | 10/2016 | Lee et al. |
| 2016/0335410 | A1* | 11/2016 | Swank ..... H04M 1/7253 |
| 2017/0308346 | A1 | 10/2017 | Lee et al. |
| 2018/0067521 | A1 | 3/2018 | Browning |
| 2018/0181164 | A1 | 6/2018 | Chen |
| 2018/0198899 | A1 | 7/2018 | Lee |

FOREIGN PATENT DOCUMENTS

| | | | |
|---|---|---|---|
| WO | 2005015302 | A1 | 2/2005 |
| WO | 2007072234 | A1 | 6/2007 |

OTHER PUBLICATIONS

Tohoku University, "Super-flexible liquid crystal device for bendable and rollable displays," ScienceDaily, Dec. 9, 2016 (3 pages).
Mark Prigg et al., "LG to unveil flexible screens that can be used in everything from smartphones to cars," https://www.dailymail.co.uk/sciencetech/article-3384028/The-TV-roll-like-newspaper-LG-unveil-flexible-screens-used-smartphones-cars.html, Daily Mail Online, Jan. 4, 2016 (35 pages).
Beciri, Damir "A roadmap for the mobile phones of the future and rollable displays", retrieved from: http://www.robaid.com/gadgets/a-roadmap-for-the-mobile-phones-of-the-future-and-rollable-displays.html; dated May 11, 2013; 3 pgs.
Statt, Nick "LG made an 18-inch display you can roll up like a newspaper", retrieved from: https://www.theverge.com/2016/1/3/10706180/lg-rollable-display-flexible-screen-announced-ces-2016; dated Jan. 3, 2016; 2 pgs.

* cited by examiner

*Primary Examiner* — Michelle Chin
(74) *Attorney, Agent, or Firm* — Cantor Colburn LLP; Tihon Poltavets

(57) ABSTRACT

A mobile device, method of controlling use of a mobile device and computer program product for operating a mobile device having a rollable display. A usage condition is received at the mobile device and stored in a database of the mobile device. A processor compares a usage level of the mobile device to the usage condition, and performs an action at the rollable display to change a value of a presentation parameter of the mobile device from a first value to a second value when the usage level meets the usage condition.

18 Claims, 4 Drawing Sheets

200

| Presentation parameter (202) | Standard value (204) | Value when usage level condition is met (206) | usage condition (208) |
|---|---|---|---|
| intensity | v1 | v1′ | condition 1 |
| contrast | v2 | v2′ | condition 2 |
| resolution | v3 | v3′ | condition 3 |

FIG. 2

CONTEXTUAL DISPLAY DIMENSION CONTROL IN ROLLABLE DISPLAY DEVICE TO REDUCE THE ADDICTION OF MOBILE DEVICE

BACKGROUND

The present invention relates to controlling usage of a mobile device, and more specifically, to a system and method of controlling presentation parameters of the mobile devices in order to reduce a user's addiction to the mobile device.

Mobile devices come in many forms, including mobile phones, smartphones, portable computers or tablets, etc. It has been noted that people tend to become hyper-concentrated on these devices as well as the content that is presented on them, at the expense of people failing to be aware of their surroundings and of neglecting important social relations and personal contact. While aware of these drawbacks, many people have developed such strong habits of using their mobile device that it is difficult to break them. In addition, mindful parents may want to prevent their children from developing the habit of excessive mobile device usage so that they can develop social skills and meaningful relationships.

SUMMARY

Embodiments of the present invention are directed to a method of controlling use of a mobile device including a rollable display. The method includes receiving a usage condition at the mobile device, comparing, at a processor of the mobile device, a usage level of the mobile device to the usage condition, and performing, by the processor, an action at the rollable display to change a value of a presentation parameter of the mobile device from a first value to a second value when the usage level meets the usage condition.

Embodiments of the present invention are directed to a mobile device including a rollable display, a data base and a processor. The database includes a usage condition for the mobile device. The processor is configured to compare a usage level of the mobile device to the usage condition, and perform an action at the rollable display to change a value of a presentation parameter of the mobile device from a first value to a second value when the usage level meets the usage condition.

Embodiments of the present invention are directed to a computer program product for operating a mobile device, the computer program product comprising a computer readable storage medium having program instructions embodied therewith, the program instructions executable by a processor to cause the processor to perform a method including: receiving a usage condition at the mobile device, the mobile device including a rollable display; comparing a usage level of the mobile device to the usage condition; and performing an action at the rollable display to change a value of a presentation parameter of the mobile device from a first value to a second value when the usage level meets the usage condition.

BRIEF DESCRIPTION OF THE DRAWINGS

FIG. 2 illustrates a database for settings or values for controlling various presentation parameters of the mobile device;

DETAILED DESCRIPTION

Figure 1:
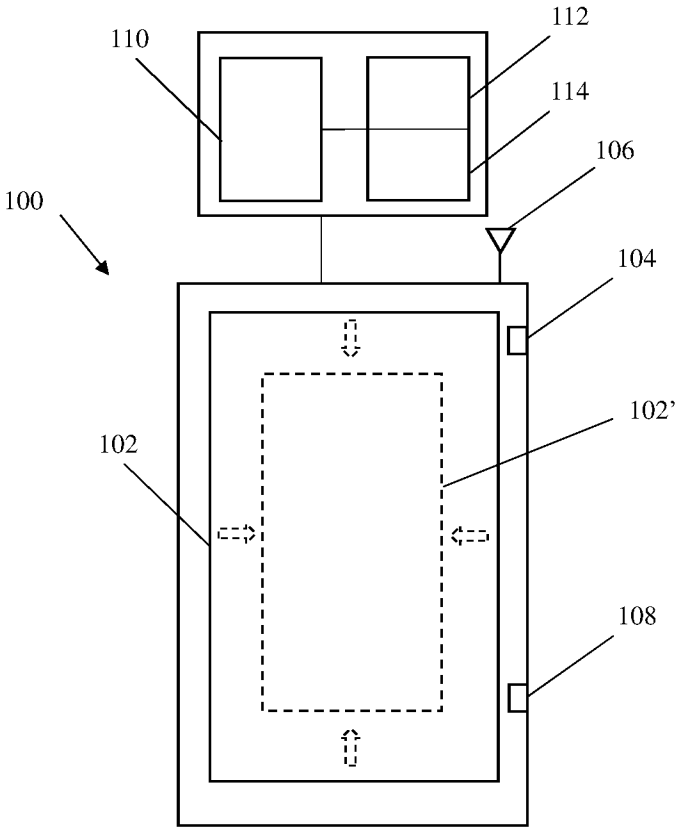
FIG. 1 illustrates a mobile device operable according to the methods disclosed herein in an embodiment.

FIG. 1 illustrates a mobile device 100 operable according to the methods disclosed herein in an embodiment. The mobile device 100 can be any suitable mobile device, such as a smartphone or tablet, in various embodiments. The mobile device 100 include a screen 102 for presenting visual information to a user or viewer, and a speaker 104 for presenting audio information to the user or viewer. In various embodiments, the screen 102 can be a touch-sensitive screen, allowing the user to enter a command or data to the mobile device 100 by touching the screen 102. The mobile device 100 can further include a communication system 106 for sending data and receiving data that can be presented to the user. The mobile device further includes sensors 108 that can determine various aspects of the user and the user's environment. Exemplary sensors include, but are not limited to, GPS sensors, motion sensors, biometric sensors, etc.

The mobile device 100 includes a processor 110 that controls various operations of the mobile device 100 as well as a memory storage device 112 having programs or instructions 114 stored therein. When accessed by the processor 110, the programs or instructions 104 enable the processor to perform various methods disclosed herein for controlling a user's engagement level with the mobile device 100.

The mobile device 100 interacts with its user, or sends information to the user, through several sensory pathways, such as visual, auditory and tactile. A presentation parameter can be a parameter that controls engagement along these sensory pathways, such as an aspect of an image at the screen 102, an aspect of sound from the speaker 104 and/or an aspect of tactile communication with the mobile device 100. Visual presentation parameters can include, for example, a contrast of the image, an intensity of the image; a color palette of the image, a size of the image, a hue of the image, whether the image is black and white or in color, an image/pixel resolution, etc. Auditory presentation parameters can include a volume level of the speaker 114, a pitch or frequency of the auditory data, sound quality, etc. Tactile presentation parameters can include a touch-sensitivity of the screen 102, which can be set so that tactile communication is hindered or difficult. These presentation parameters can be set by the user.

The level or value of the presentation parameter can affect the engagement level of the user. A first value of a presentation parameter can be selected to increase or optimize a user's engagement with the mobile device, while a second value can be selected that decreases or impedes the user's engagement. For example, an effective screen size can be a presentation parameter. A large screen can engage a user to a greater degree than a small screen, if only due to the amount of the field of vision of the user taken up by the large screen. Additionally, data presented on a small screen can be more difficult to read than data presented on a large screen. The small screen, therefore, introduces many subtle physical discomforts (such as squinting, moving the screen with respect to the user's eyes, etc.) that inhibit the user's engagement with the mobile device.

Referring to FIG. 1, changing of an effective viewing size of screen 102 of the mobile device 100 is shown. When operating under standard conditional, an image presented at the mobile device 100 takes up the entire screen 102. When the usage level meets a usage condition, the image is displayed over an effective screen size 102', which is reduced from the larger screen size of screen 102, thereby reducing the user's level of engagement with the mobile device. It is noted that for a mobile device 100 that has a configurable screen, the size of the screen itself can be reduced, rather just the size of the image presented at the screen.

FIG. 2 illustrates a database 200 for settings or values for controlling various presentation parameters. Four columns of the database 200 are shown. In the first column 202, the presentation parameters are listed. Exemplary presentation parameters of intensity, contrast, and resolution are shown for illustrative purposes. In the second column 204, standard levels for the presentation parameters are listed. For example, the intensity has standard value v1, contrast has standard value v2 and resolution has standard value v3. The third column 206 lists conditional levels for the presentation parameter for when a usage level of the mobile device is exceeded or when some other restriction is placed on the usage of the mobile device. When this occurs, the intensity takes on conditional value v1', contrast takes on conditional value v2' and resolution takes on conditional value v3'. The fourth column 208 lists usage conditions for each of the presentation parameters. For example, the intensity is subject to condition 1, contrast is subject to condition 2 and resolution is subject to condition 3. The conditions can be the same for each presentation parameter or different for one or more presentation parameters, in various embodiments. The user or viewer can change or set usage conditions as well as standard values for the presentation parameters and conditional values for the presentation parameters.

In various embodiments, the value of the presentation parameter is controlled based on a usage condition of the mobile device 100. In other words, the user can set a usage condition at the mobile device that controls an amount of time, or a time of day, time or week, time of the month, etc. that the user uses the mobile device using the standard values of the presentation parameter. The usage condition can indicate, for example, how many hours a day/week/month/etc. are permitted for use of the mobile device. For example, the usage condition can indicate a limit or four hours per day of mobile device 100 usage. The usage condition can also or alternatively indicate a selected period of time during the day/week/month/etc. during which the mobile device is to operate on conditional values of its presentation parameters. For example, the usage condition can indicate operating the mobile device 100 using the conditional values of the presentation parameter during dinner time, e.g., from 7:00 p.m. to 8:00 p.m.

In alternative embodiments, the mobile device 100 can detect that the user is in motion or walking and can change presentation parameter levels appropriately. Additionally, the mobile device can determine its location (e.g., a classroom) and change presentation parameter levels appropriately for the location. The mobile device can determine if a user is having a lower than expected participation with people in a group and change presentation parameters accordingly. In various embodiments, the mobile device can track biometric parameters of the user and identify, from the changes in biometric parameters, material that disturbs the user and changes presentation parameters accordingly.

When the usage level of the mobile device 100 meets a usage condition, the mobile device 100 changes a value of the presentation parameter from the standard value (e.g., first value v1) to the conditional value (e.g., second value v1'). The conditional value of the presentation parameter is selected to change or reduce the engagement level of the user with the mobile device. For example, the effective screen size can be reduced, making it more difficult to view what is being presented at the screen. Additionally, the volume of the speaker 114 can be reduced, making it difficult to hear what is being presented. Further, the responsive of the screen 102 to tactile input can be reduced, frustrating the user's attempts to enter a command into the mobile device 100. The conditional values of the presentation parameters are intended to reduce the user's level of engagement in the mobile device 100, encouraging the user to take up another activity that does not involve the mobile device 100.

Figure 3:
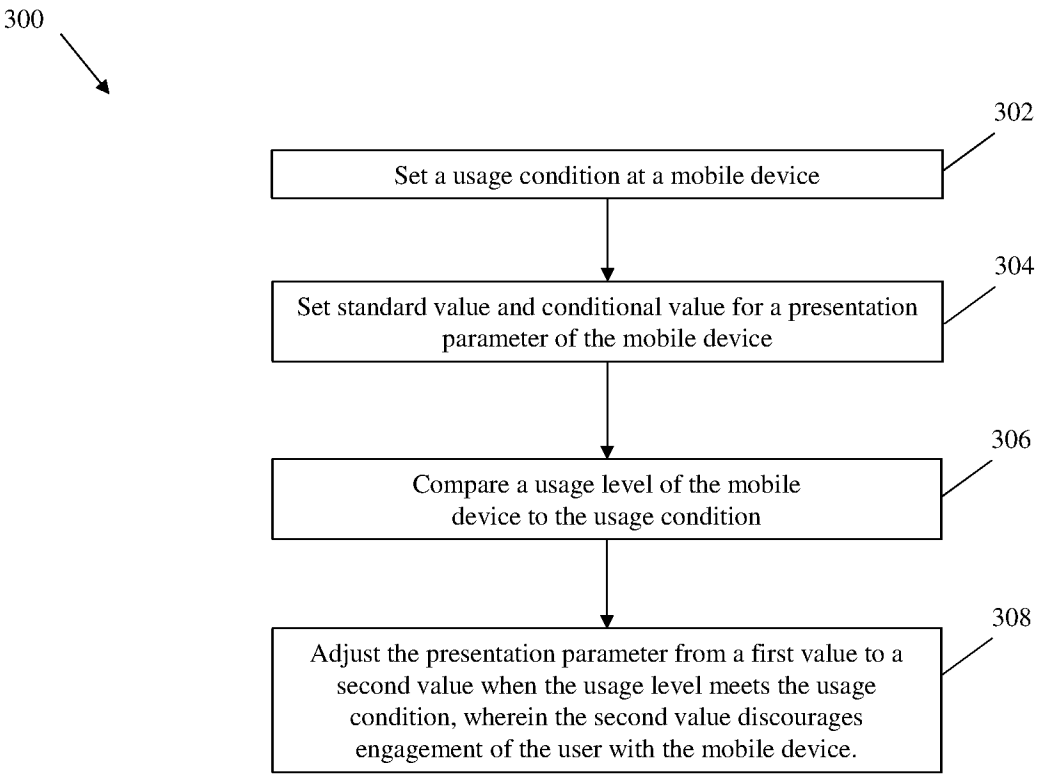
FIG. 3 shows a flowchart of a method for operation of the mobile device using the methods disclosed herein.

FIG. 3 shows a flowchart 300 of a method for operation of the mobile device 100 using the methods disclosed herein. In box 302, a usage condition is set at the mobile device 100. The usage condition can be entered in the mobile device 100 by a user. In box 304, a first or standard value and a second or conditional value for the mobile device 100 are entered into the mobile device 100, with the mobile device 100 operating with the standard level of the presentation parameter. In box 306, a usage level of the mobile device is compared to the usage condition. In box 308, when the usage level meets the usage condition, the presentation parameter is changed from the first or standard value to the second or conditional value. The second or conditional value is selected in order to reduce or discourage the user's engagement with the mobile device 100.

Figure 4:
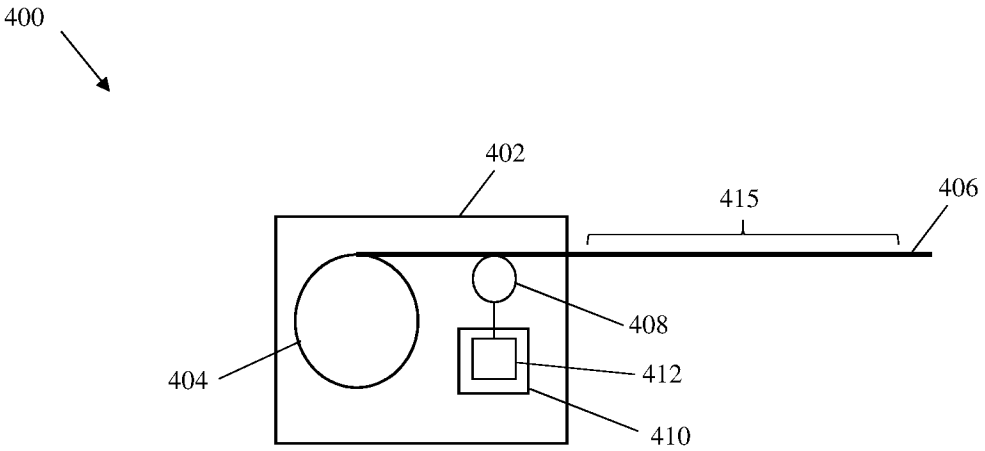
FIG. 4 shows a mobile device including a rollable display.

FIG. 4 shows a mobile device 400 including a rollable display 406. The rollable display 406 can be made of a flexible substrate that can be rolled up for storage and unrolled to produce a viewing region 415 at which images can be shown for viewing. The size of the viewing region 415 controls an effective viewing size of an image at the rollable display 406. The mobile device 400 includes a housing 402 that includes a cylinder 404 about which the display 406 can be wound for storage when not in use. The housing 402 further includes a feeder 408 that unrolls the display 406 from the cylinder 404 and extends the display 406 from the housing 402 or retracts the display into the housing 402 and onto the cylinder 404 based on a selected command. A control unit 410 controls various parameters of the mobile device 400 in order to control a user's interest level in the mobile device 400 and/or the content presented at the mobile device 400, as discussed herein with respect to FIGS. 1-3. The control unit 410 can include a motor 412 for actuating the feeder 408. The control unit 410 can control the size of the viewable region 415 either by rolling the display 406 out of the housing 402 to increase the size of the viewable region 415 or by rolling the display 406 into the housing 402 and onto the cylinder 404 to decrease the size of the viewable region 415. The control unit 410 can change the size of the viewable region 415 in response to a usage level of the mobile device 400, such as when the usage level meets a usage condition, as discussed herein. Thus, when the usage level indicates that the user has spent a certain amount of time on the mobile device 400, the control unit 410 can decrease the size of the viewing region 415, thereby reducing the effective viewing size in order to decrease the user's level of interest. In particular, the size of the viewing region 415 can be changed from a first size to a selected second size.

Additional processes also can be included, and it should be understood that the processes depicted herein represent illustrations and that other processes can be added or existing processes can be removed, modified, or rearranged without departing from the scope and spirit of one or more embodiments of the present invention.

The present techniques can be implemented as a system, a method, and/or a computer program product. The computer program product can include a computer readable storage medium (or media) having computer readable program instructions thereon for causing a processor to carry out aspects of one or more embodiments of the present invention.

The computer readable storage medium can be a tangible device that can retain and store instructions for use by an instruction execution device. The computer readable storage medium can be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network can comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of one or more embodiments of the present invention can be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Smalltalk, C++ or the like, and conventional procedural programming languages, such as the "C" programming language or similar programming languages. The computer readable program instructions can execute entirely on the user's computer, partly on the user's computer, as a stand-alone software package, partly on the user's computer and partly on a remote computer or entirely on the remote computer or server. In the latter scenario, the remote computer can be connected to the user's computer through any type of network, including a local area network (LAN) or a wide area network (WAN), or the connection can be made to an external computer (for example, through the Internet using an Internet Service Provider). In some examples, electronic circuitry including, for example, programmable logic circuitry, field-programmable gate arrays (FPGA), or programmable logic arrays (PLA) can execute the computer readable program instructions by utilizing state information of the computer readable program instructions to personalize the electronic circuitry, in order to perform aspects of one or more embodiments of the present invention.

Aspects of one or more embodiments of the present invention are described herein with reference to flowchart illustrations and/or block diagrams of methods, apparatus (systems), and computer program products according to one or more embodiments of the present invention. It will be understood that each block of the flowchart illustrations and/or block diagrams, and combinations of blocks in the flowchart illustrations and/or block diagrams, can be implemented by computer readable program instructions.

These computer readable program instructions can be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions can also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions can also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the figures illustrate the architecture, functionality, and operation of possible implementations of systems, methods, and computer program products according to various aspects of one or more embodiments of the present invention. In this regard, each block in the flowchart or block diagrams can represent a module, segment, or portion of instructions, which comprises one or more executable instructions for implementing the specified logical function(s). In some alternative implementations, the functions noted in the block can occur out of the order noted in the figures. For example, two blocks shown in succession can, in fact, be executed substantially concurrently, or the blocks can sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described techniques. The terminology used herein was chosen to best explain the principles of the present techniques, the practical application or technical improvement over technologies found in the marketplace, or to enable others of ordinary skill in the art to understand the techniques disclosed herein.

What is claimed is:

1. A method of controlling use of a mobile device, comprising:

receiving a usage condition at the mobile device, the mobile device including a rollable display, wherein the usage condition indicates a permitted amount of usage of the mobile device during a selected time period;

comparing, at a processor of the mobile device, a usage level of the mobile device to the usage condition; and performing, by the processor, an action at the rollable display to change a value of a presentation parameter of the mobile device from a first value to a second value when the usage level meets the usage condition.

2. The method of claim 1, wherein changing value of the presentation parameter controls an engagement level of a user with the mobile device.

3. The method of claim 1, wherein the presentation parameter is at least one of: (i) an effective screen size; (ii) a color intensity at a screen of the mobile device; (iii) a color palette of the screen; (iv) a color contrast level at the screen; (v) an image resolution at the screen; (vi) an effective size of an image at the screen; (vii) a sound volume at a speaker of the mobile device; (viii) a sound quality at the speaker; and (ix) a touch sensitivity of the mobile device.

4. The method of claim 1, wherein the presentation parameter includes an effective screen size of the rollable display, further comprising moving the rollable display by a selected amount in order to decrease the effective screen size.

5. The method of claim 1, wherein the usage condition defines the selected time period.

6. The method of claim 1, wherein the usage condition defines at least one of:

(i) a location of the mobile device; (ii) a motion of a user of the mobile device; and (iii) a biometric response of the user.

7. A mobile device, comprising:

a rollable display;

a database including a usage condition for the mobile device, wherein the usage condition indicates a permitted amount of usage of the mobile device during a selected time period;

a processor configured to:

compare a usage level of the mobile device to the usage condition; and perform an action at the rollable display to change a value of a presentation parameter of the mobile device from a first value to a second value when the usage level meets the usage condition.

8. The mobile device of claim 7, wherein a value of the presentation parameter affects an engagement level of a user with the mobile device.

9. The mobile device of claim 7, wherein the presentation parameter is at least one of: (i) an effective screen size; (ii) a color intensity at a screen of the mobile device; (iii) a color palette of the screen; (iv) a color contrast level at the screen; (v) an image resolution at the screen; (vi) an effective size of an image at the screen; (vii) a sound volume at a speaker of the mobile device; (viii) a sound quality at the speaker; and (ix) a touch sensitivity of the mobile device.

10. The mobile device of claim 7, wherein the presentation parameter includes an effective screen size of the rollable display, wherein the processor moves the rollable display by a selected amount in order to decrease the effective screen size.

11. The mobile device of claim 7, wherein the usage condition defines the selected time period.

12. The mobile device of claim 7, wherein the usage condition defines at least one of: (i) a location of the mobile device; (ii) a motion of a user of the mobile device; and (iii) a biometric response of the user.

13. A computer program product for operating a mobile device, the computer program product comprising a computer readable storage medium having program instructions embodied therewith, the program instructions executable by a processor to cause the processor to perform a method comprising:

receive a usage condition at the mobile device, the mobile device including a rollable display, wherein the usage condition indicates a permitted amount of usage of the mobile device during a selected time period;

compare a usage level of the mobile device to the usage condition; and perform an action at the rollable display to change a value of a presentation parameter of the mobile device from a first value to a second value when the usage level meets the usage condition.

14. The computer program product of claim 13, wherein changing value of the presentation parameter controls an engagement level of a user with the mobile device.

15. The computer program product of claim 13, wherein the presentation parameter is at least one of: (i) an effective screen size; (ii) a color intensity at a screen of the mobile device; (iii) a color palette of the screen; (iv) a color contrast level at the screen; (v) an image resolution at the screen; (vi) an effective size of an image at the screen; (vii) a sound volume at a speaker of the mobile device; (viii) a sound quality at the speaker; and (ix) a touch sensitivity of the mobile device.

16. The computer program product of claim 13, wherein the presentation parameter includes an effective screen size of the rollable display, wherein the processor moves the rollable display by a selected amount in order to decrease the effective screen size.

17. The computer program product of claim 13, wherein the usage condition indicates at least one of: (i) a permitted amount of usage of the mobile device during a selected time period; and (ii) a selected time period.

18. The computer program product of claim 13, wherein the usage condition defines at least one of: (i) a location of the mobile device; (ii) a motion of a user of the mobile device; and (iii) a biometric response of the user.

* * * * *